US008157504B2

(12) United States Patent
Amaral et al.

(10) Patent No.: US 8,157,504 B2
(45) Date of Patent: Apr. 17, 2012

(54) ROTOR BLADES FOR TURBINE ENGINES

(75) Inventors: Sergio Daniel Marques Amaral, Simpsonville, SC (US); Michael A. Sullivan, Woodstock, GA (US); Xiuzhang J. Zhang, Simpsonville, SC (US); Gary M. Itzel, Simpsonville, SC (US); Felipe Roman-Morales, Simpsonville, SC (US); Scott E. Ellis, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 468 days.

(21) Appl. No.: 12/425,434

(22) Filed: Apr. 17, 2009

(65) Prior Publication Data

US 2010/0266410 A1 Oct. 21, 2010

(51) Int. Cl.
*F03B 11/00* (2006.01)
*F01D 5/20* (2006.01)

(52) U.S. Cl. ..... 415/115; 415/116; 415/173.1; 415/173.4; 415/173.5; 416/97 R; 416/96 R

(58) Field of Classification Search ..... 415/115, 415/116, 173.1, 173.4, 173.5; 416/97 R, 416/96 R See application file for complete search history.

(56) References Cited

U.S. PATENT DOCUMENTS

| | | | | |
|---|---|---|---|---|
| 5,125,798 | A | 6/1992 | Muth et al. | |
| 5,261,789 | A | 11/1993 | Butts et al. | |
| 5,503,527 | A | 4/1996 | Lee et al. | |
| 5,511,946 | A | 4/1996 | Lee et al. | |
| 5,733,102 | A | 3/1998 | Lee et al. | |
| 5,927,946 | A | 7/1999 | Lee | |
| 6,059,530 | A | 5/2000 | Lee | |
| 6,179,556 | B1 | 1/2001 | Bunker | |
| 6,183,194 | B1 | 2/2001 | Cunha et al. | |
| 6,190,129 | B1 | 2/2001 | Mayer et al. | |
| 6,499,949 | B2 | 12/2002 | Schafrik et al. | |
| 7,059,834 | B2 | 6/2006 | Chlus et al. | |
| 7,278,826 | B2 | 10/2007 | Blaskovich et al. | |
| 7,300,250 | B2 | 11/2007 | Papple | |
| 2003/0108425 | A1 | 6/2003 | Bariaud et al. | |
| 2005/0244270 | A1* | 11/2005 | Liang | 416/97 R |
| 2006/0171809 | A1* | 8/2006 | Albrecht et al. | 416/97 R |
| 2008/0118367 | A1 | 5/2008 | Liang et al. | |

* cited by examiner

*Primary Examiner* — Michelle Mandala
(74) *Attorney, Agent, or Firm* — Mark E. Henderson; Ernest G. Cusick; Frank A. Landgraff

(57) ABSTRACT

A blade tip of a turbine rotor blade for a gas turbine engine, the turbine rotor blade including an airfoil and a root portion for mounting the airfoil along a radial axis to a rotor disk inboard of a turbine shroud, a pressure sidewall and a suction sidewall that join together at a leading edge and a trailing edge, the pressure sidewall and suction sidewall extending from the root portion to the blade tip, and a squealer tip cavity formed at the blade tip, the blade tip comprising: a trailing edge trench originating at the squealer tip cavity, wherein the trailing edge trench generally extends toward the trailing edge of the blade tip.

24 Claims, 7 Drawing Sheets

ROTOR BLADES FOR TURBINE ENGINES

BACKGROUND OF THE INVENTION

The present application relates generally to apparatus, methods and/or systems concerning the design of turbine rotor blade tips. More specifically, but not by way of limitation, the present application relates to apparatus, methods and/or systems related to turbine blade tips that include a trailing edge trench cavity that, among other advantages, improves the cooling of the blade tip.

In a gas turbine engine, it is well known that air pressurized in a compressor is used to combust a fuel in a combustor to generate a flow of hot combustion gases, whereupon such gases flow downstream through one or more turbines so that energy can be extracted therefrom. In accordance with such a turbine, generally, rows of circumferentially spaced turbine rotor blades extend radially outwardly from a supporting rotor disk. Each blade typically includes a dovetail that permits assembly and disassembly of the blade in a corresponding dovetail slot in the rotor disk, as well as an airfoil that extends radially outwardly from the dovetail and interacts with the flow of the working fluid through the engine.

The airfoil has a generally concave pressure side and generally convex suction side extending axially between corresponding leading and trailing edges and radially between a root and a tip. It will be understood that the blade tip is spaced closely to a radially outer turbine shroud for minimizing leakage therebetween of the combustion gases flowing downstream between the turbine blades. Improved efficiency of the engine is obtained by minimizing the tip clearance or gap such that leakage is prevented, but this strategy is limited somewhat by the different thermal and mechanical expansion and contraction rates between the rotor blades and the turbine shroud and the motivation to avoid an undesirable scenario of having the tip rub against the shroud during operation.

In addition, because turbine blades are bathed in hot combustion gases, effective cooling is required for ensuring a useful part life. Typically, the blade airfoils are hollow and disposed in flow communication with the compressor so that a portion of pressurized air bled therefrom is received for use in cooling the airfoils. Airfoil cooling is quite sophisticated and may be employed using various forms of internal cooling channels and features, as well as cooling holes through the outer walls of the airfoil for discharging the cooling air. Nevertheless, airfoil tips are particularly difficult to cool since they are located directly adjacent to the turbine shroud and are heated by the hot combustion gases that flow through the tip gap. Accordingly, a portion of the air channeled inside the airfoil of the blade is typically discharged through the tip for the cooling thereof.

It will be appreciated that conventional blade tip design includes several different geometries and configurations that are meant prevent leakage and increase cooling effectiveness. Exemplary patents include: U.S. Pat. No. 5,261,789 to Butts et al.; U.S. Pat. No. 6,179,556 to Bunker; U.S. Pat. No. 6,190,129 to Mayer et al.; and, U.S. Pat. No. 6,059,530 to Lee. Conventional blade tip designs, however, all have certain shortcomings, including a general failure to adequately reduce leakage and/or allow for efficient tip cooling that minimizes the use of efficiency-robbing compressor bypass air. Improvement in the pressure distribution near the tip region is still sought to further reduce the overall tip leakage flow and thereby increase turbine efficiency. As a result, a turbine blade tip design that alters the pressure distribution near the tip region and otherwise reduces the overall tip leakage flow, thereby increasing the overall efficiency of the turbine engine, would be in great demand. Further, it is also desirable for such a blade tip to enhance the cooling characteristics of the cooling air that is released at the blade tip, as well as, enhancing the overall aerodynamic performance of the turbine blade. Particularly, it would be desirable for an improved tip design that better allowed the flow of cooling air to move toward the trailing edge of the tip blade, which, generally, is a difficult area to cool.

BRIEF DESCRIPTION OF THE INVENTION

The present application thus describes a blade tip of a turbine rotor blade for a gas turbine engine, the turbine rotor blade including an airfoil and a root portion for mounting the airfoil along a radial axis to a rotor disk inboard of a turbine shroud, a pressure sidewall and a suction sidewall that join together at a leading edge and a trailing edge, the pressure sidewall and suction sidewall extending from the root portion to the blade tip, and a squealer tip cavity formed at the blade tip, the blade tip comprising: a trailing edge trench originating at the squealer tip cavity, wherein the trailing edge trench generally extends toward the trailing edge of the blade tip.

In some embodiments, the blade tip comprises a tip plate that extends between the outer radial edge of the pressure sidewall to the outer radial edge of the suction sidewall; the squealer tip cavity is formed on a first side by a pressure tip wall that extends radially outwardly from the tip plate, traversing from the leading edge to the trailing edge such that the pressure tip wall resides approximately adjacent to the termination of the pressure sidewall; and the squealer tip cavity is formed on a second side by a suction tip wall that extends radially outwardly from the tip plate, traversing from the leading edge to the trailing edge such that the suction tip wall resides approximately adjacent to the termination of the suction sidewall.

These and other features of the present application will become apparent upon review of the following detailed description of the preferred embodiments when taken in conjunction with the drawings and the appended claims.

BRIEF DESCRIPTION OF THE DRAWINGS

These and other features of this invention will be more completely understood and appreciated by careful study of the following more detailed description of exemplary embodiments of the invention taken in conjunction with the accompanying drawings, in which.

DETAILED DESCRIPTION OF THE INVENTION

Figure 1:
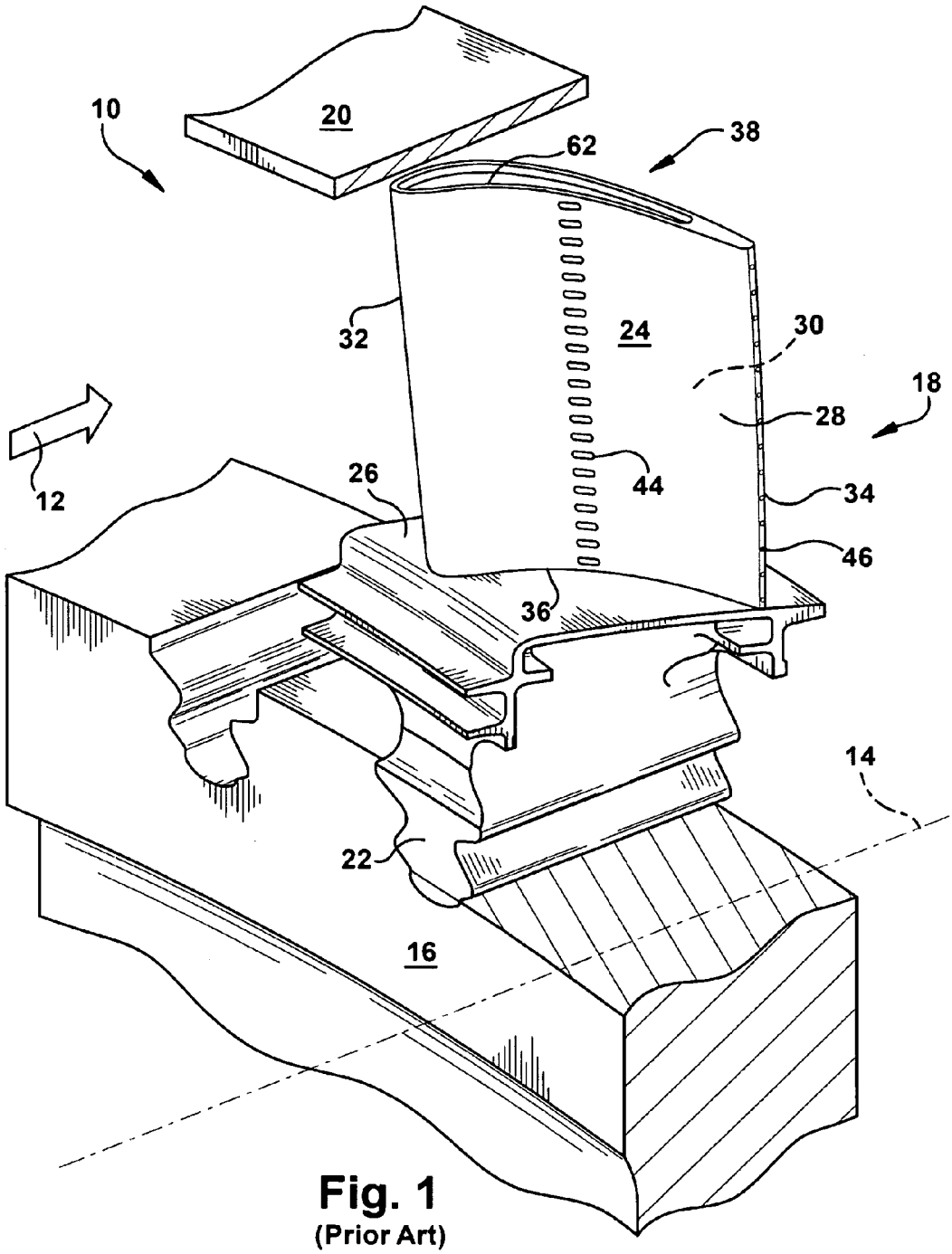
Fig. 1 (Prior Art)
FIG. 1 is a partly sectional, isometric view of an exemplary gas turbine engine rotor blade mounted in a rotor disk within a surrounding shroud, with the blade having a convention tip design.

Referring now to the drawings, wherein identical numerals indicate the same elements throughout the figures, FIG. 1 depicts a portion of a turbine 10 of a gas turbine engine. The turbine 10 is mounted downstream from a combustor (not shown) for receiving hot combustion gases 12 therefrom. The turbine 10, which is axisymmetrical about an axial centerline axis 14, includes a rotor disk 16 and a plurality of circumferentially spaced apart turbine rotor blades 18 (one of which is shown) extending radially outwardly from the rotor disk 16 along a radial axis. An annular turbine shroud 20 is suitably joined to a stationary stator casing (not shown) and surrounds blades 18 for providing a relatively small clearance or gap therebetween for limiting leakage of combustion gases 12 therethrough during operation.

Each blade 18 generally includes a dovetail 22 which may have any conventional form, such as an axial dovetail configured for being mounted in a corresponding dovetail slot in the perimeter of the rotor disk 16. A hollow airfoil 24 is integrally joined to dovetail 22 and extends radially or longitudinally outwardly therefrom. The blade 18 also includes an integral platform 26 disposed at the junction of the airfoil 24 and the dovetail 22 for defining a portion of the radially inner flowpath for combustion gases 12. It will be appreciated that the blade 18 may be formed in any conventional manner, and is typically a one-piece casting.

It will be seen that the airfoil 24 preferably includes a generally concave pressure sidewall 28 and a circumferentially or laterally opposite, generally convex suction sidewall 30 extending axially between opposite leading and trailing edges 32 and 34, respectively. The sidewalls 28 and 30 also extend in the radial direction between a radially inner root 36 at the platform 26 and a radially outer tip or blade tip 38, which will be described in more detail in the discussion related to FIG. 2. Further, the pressure and suction sidewalls 28 and 30 are spaced apart in the circumferential direction over the entire radial span of airfoil 24 to define at least one internal flow chamber or channel for channeling cooling air through the airfoil 24 for the cooling thereof. Cooling air is typically bled from the compressor (not shown) in any conventional manner.

The inside of the airfoil 24 may have any configuration including, for example, serpentine flow channels with various turbulators therein for enhancing cooling air effectiveness, with cooling air being discharged through various holes through airfoil 24 such as conventional film cooling holes 44 and trailing edge discharge holes 46.

Figure 2:
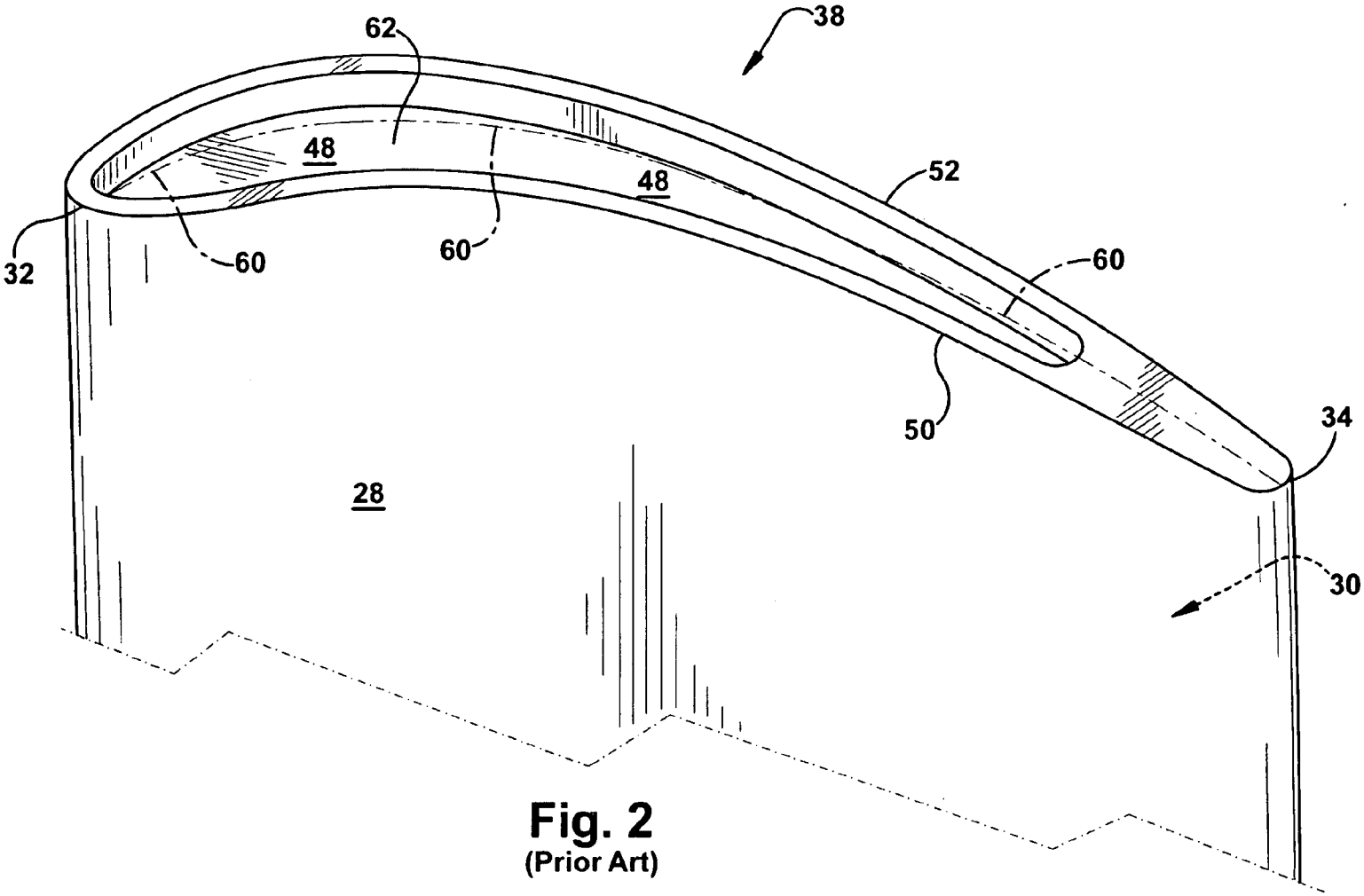
Fig. 2 (Prior Art)
FIG. 2 is an isometric view of the convention blade tip as illustrated in FIG. 1.

As better appreciated in FIG. 2, according to a conventional design, the blade tip 38 generally includes a tip plate 48 disposed atop the radially outer ends of the pressure and suction sidewalls 28 and 30, where the tip plate 48 bounds internal cooling cavities. The tip plate 48 may be integral to the rotor blade 18 or may be welded into place. A pressure tip wall 50 and a suction tip wall 52 may be formed on the tip plate 48. Generally, the pressure tip wall 50 extends radially outwardly from the tip plate 48 and extends axially from the leading edge 32 to the trailing edge 34. Generally, the pressure tip wall 50 forms an angle with the tip plate 48 that is approximately 90°, though this may vary. The path of pressure tip wall 50 is adjacent to or near the termination of the pressure sidewall 28 (i.e., at or near the periphery of the tip plate 48 along the pressure sidewall 28).

Similarly, the suction tip wall 52 generally extends radially outwardly from the tip plate 48 and extends axially from the leading edge 32 to the trailing edge 34. The path of suction tip wall 52 is adjacent to or near the termination of the suction sidewall 30 (i.e., at or near the periphery of the tip plate 48 along the suction sidewall 30). The height and width of the pressure tip wall 50 and/or the suction tip wall 52 may be varied depending on best performance and the size of the overall turbine assembly. As shown, the pressure tip wall 50 and/or the suction tip wall 52 may be approximately rectangular in shape; other shapes are also possible. A tip mid-chord line 60 also is depicted as a dashed line on FIG. 2. As illustrated, the tip mid-chord line 60 is a reference line extending from the leading edge 32 to the trailing edge 34 that connects the approximate midpoints between the pressure tip wall 50 and the suction tip wall 52. Though not shown in FIG. 1 or 2, in some instances, one or more ribs may be present that connect the pressure tip wall 50 and the suction tip wall 52. Though not depicted in FIGS. 3 through 7, the ribs also may be present in exemplary embodiments of the present, though they are not a critical feature.

The pressure tip wall 50 and the suction tip wall 52 generally form what is referred to herein as a squealer tip cavity 62. In generally terms, the squealer tip cavity 62 may include any radially inward extending depression or cavity formed on the blade tip 38. Generally, the squealer tip cavity 62 has a similar shape or form as the airfoil 24, though other shapes are possible, and be bound by: 1) a radially outward extending wall aligned with the pressure sidewall 28, which herein has been described as the pressure tip wall 50; 2) a radially outward extending wall aligned with the suction sidewall 30, which herein has been described as the suction tip wall 52; 3) and an inner radial floor, which herein has been described as the tip plate 48. The squealer tip cavity 62 may be open through the plane that defines the outer radial limits of the cavity 62. As a result, generally, upon installation, the squealer tip cavity 62 is substantially enclosed by the surrounding stationary shroud 20, though the outer surface of pressure tip wall 50 and the suction tip wall 52 are offset from the shroud 20 by a desired clearance.

As one of ordinary skill in the art will appreciate, one or more cooling apertures (not shown in FIG. 1 or 2) may be present within the squealer tip cavity 62. The cooling apertures are configured to deliver a supply of coolant, which generally comprises a supply of compressed air bled from the compressor, from cavities within the airfoil 24 to the squealer tip cavity 62. In operation, the flow of coolant within the squealer tip cavity 62 cools the outer surface of the part while also partially insulating the blade tip 38 from the extreme temperatures of the surrounding flow of working fluid. In this manner, the blade tip 38 may be maintained at an acceptable temperature during operation. As one of ordinary skill in the art will appreciate, the blade tip 38 is a difficult area of the blade to cool and, thus, generally requires a high level of coolant flow through the squealer tip cavity 62. Particularly, the trailing edge of the blade tip 38 is difficult to keep cool in conventional systems because of the aerodynamics of the part (i.e., most coolant is swept over the suction tip wall 52 before reaching the trailing edge of the blade tip 38). Coolant used in this manner has a negative effect on turbine engine efficiency and, thus, minimizing its usage improves engine performance.

Figure 3:
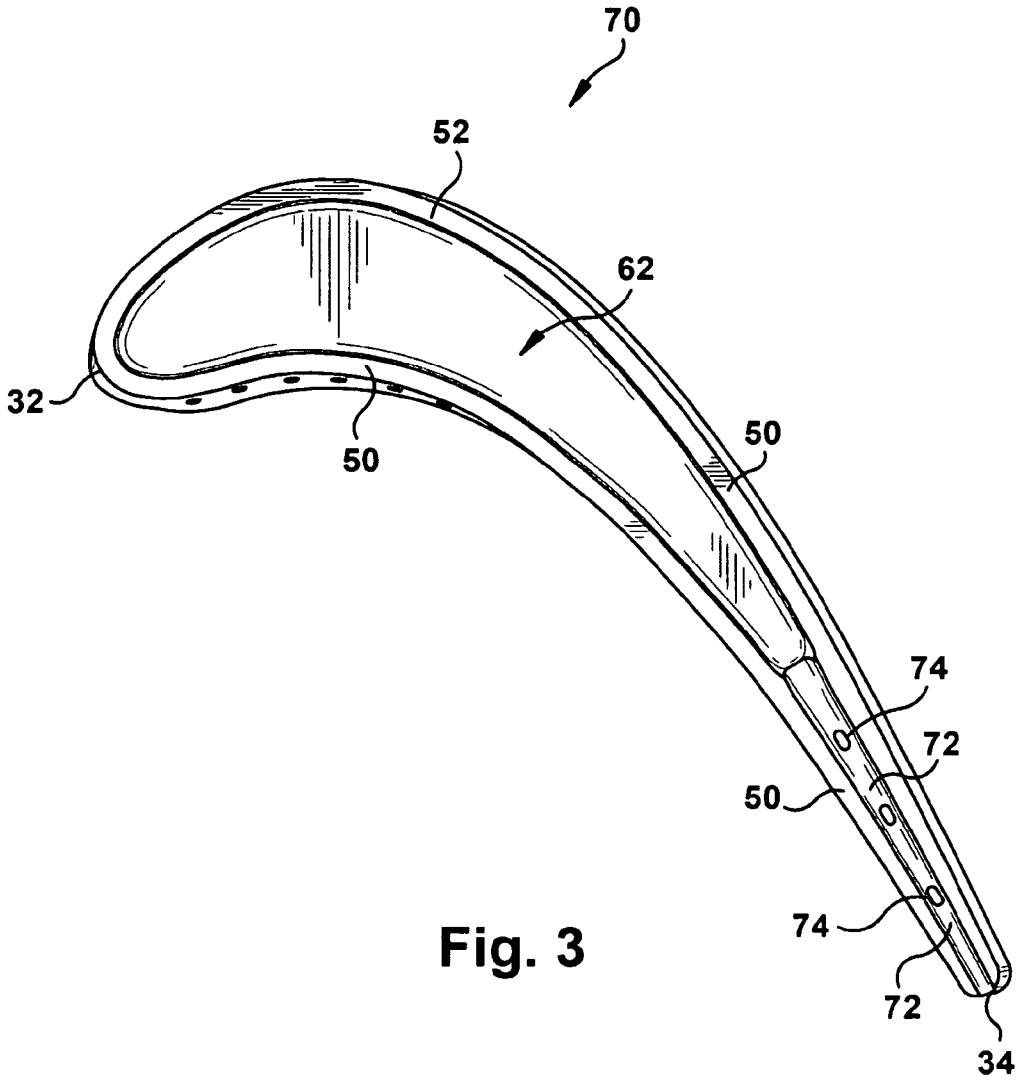
FIG. 3 is a top view of a turbine rotor blade have a tip pursuant to an exemplary embodiment of the present invention.
Figure 4:
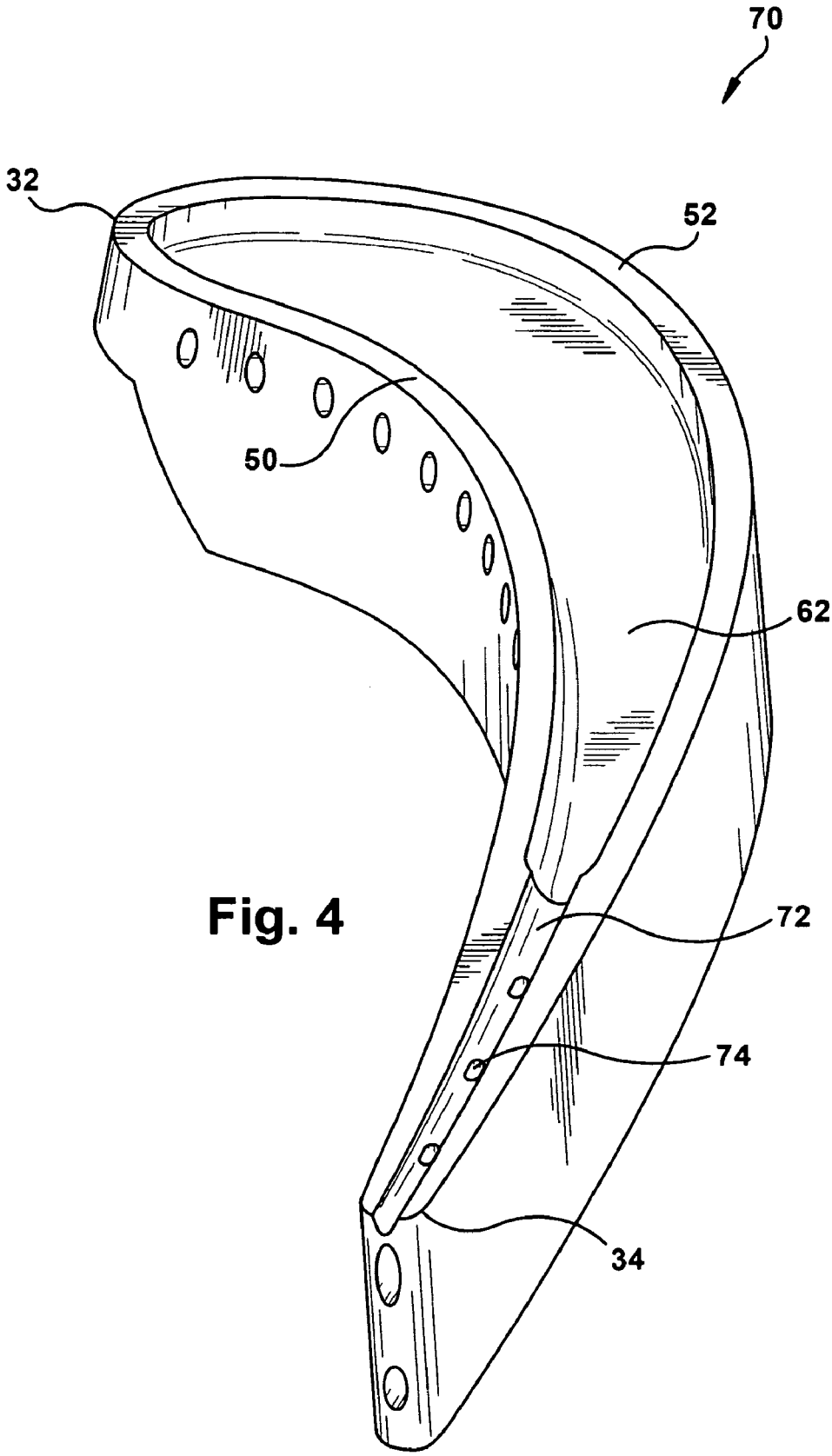
FIG. 4 is an isometric view of the turbine rotor blade tip of FIG. 3.

FIGS. 3 and 4 illustrates a blade 70 according to a preferred embodiment of the present application. As shown, the rotor blade 70 includes a tip plate 48, a pressure tip wall 50, a suction tip wall 52, and a squealer tip cavity 62, which generally are similar in configuration and nature to the like-referenced features described above in relation to the blade tip 38 of FIGS. 1 and 2. According to exemplary embodiments of the present application, the blade tip 38 of blade 70 includes a trailing edge trench 72. As described in more detail below, a trailing edge trench 72 comprises a depression, groove, notch, trench, or similar formation that is positioned between the aft end of the squealer tip cavity 62 and the trailing edge 34 of the blade tip 38. (Note, as used herein, "aft" refers to a direction that is closer to the downstream or trailing edge 34 of the blade tip 38 while "forward" refers to the upstream or leading edge 32 of the blade tip 38.)

The trailing edge trench 72 of the present invention may comprise several different shapes, sizes, alignments, and configurations, as discussed in detail below. For example, as shown in FIGS. 3 and 4, the trench 72 may extend along a substantially linear path between the aft end of the squealer tip cavity 62 and the trailing edge 34 of the blade tip 38. Generally, the longitudinal axis of the trailing edge trench 72 is aligned in an approximate downstream direction. In some embodiments, the trailing edge trench 72 may be approximately aligned with the tip mid-chord line 60, which, in some instances, depending on the curvature of the blade tip 38 in this region, may mean that the trench 72 is slightly arcuate in nature. In some other preferred embodiments (not shown), the path of the trailing edge trench 72 may be approximately parallel with the tip mid-chord line 60, but be located closer to the pressure sidewall 28 than the suction sidewall 30. Because cooling air that flow out of the trailing edge trench 72 generally moves toward the suction sidewall 30, this configuration may allow escaping cooling to flow over a greater tip surface air and, thereby, have a greater cooling effect than if the trailing edge trench 72 were located closer to the suction sidewall 30. In other embodiments of the present invention, the trailing edge trench 72 may be approximately parallel with the tip mid-chord line 60, but be located closer to the suction sidewall 30 than the pressure sidewall 28. In addition, the trailing edge trench 72, wherever located, may have a curved, linear, zig-zagging or serpentine path. In some embodiments, the trailing edge trench 72 may be treated with a coating, such as a bond coat or other type of high-temperature coating. In preferred embodiments, the coating may be a corrosion inhibitor with a high aluminum content, such as an alumide coating. An alumide coating is well-suited for the interior of the trailing edge trench 72 because this location is relatively sheltered from rubbing against adjacent parts. Alumide coatings are highly effective against corrosion, but tend to wear quickly and, thus, normally would not be used on the blade tip area of a turbine blade. The trailing edge trench 72 provides a cost-effective opportunity for its usage in this area.

As better appreciated in FIGS. 4, the cross-sectional profile of the trailing edge trench 72 may be approximately semi-elliptical in nature. Alternatively, though not depicted in the figures, the profile of the trailing edge trench 72 may be rectangular, semi-circular, triangular, trapezoidal, "V" shaped, "U" shaped and other similar shapes, as well as other combinations of profiles and filet radii. The edge formed between the top of the pressure tip wall 50/the suction tip wall 52 and the radially aligned walls of the trailing edge trench 72 may be sharp (i.e., a 90 degree corner) or, in some cases, more rounded in nature.

The depth of the trailing edge trench 72 may be substantially constant as it extends toward the trailing edge 34. Note that as used herein, the depth of the trailing edge trench 72 is meant to refer to the maximum radial height of the trench 72 at a given location on its path. Thus, in the case of a semi-elliptical profile, the depth of the trailing edge trench 72 occurs at the inward apex of the elliptical shape. In some preferred embodiments, the depth of the trailing edge trench 72 may be between approximately 110% and 40% of the depth of the aft end of the squealer tip cavity 62 (i.e., the approximate position in the squealer tip cavity 62 where the trailing edge trench 72 originates). More preferably, the depth of the trailing edge trench 72 may be between approximately 100% and 75% of the depth of the aft end of the squealer tip cavity 62 (i.e., the approximate position in the squealer tip cavity 62 where the trailing edge trench 72 originates).

In other embodiments, as shown in FIGS. 3 and 4, the depth of the trailing edge trench 72 may vary along it path between the squealer tip cavity 62 and the trailing edge 34. In some preferred embodiments, the depth of the trailing edge trench 72 may gradually become shallower as the trench 72 extends toward the trailing edge 34. In such cases, the depth at the forward end of the trailing edge trench 72 may be between approximately 110% and 40% of the depth of the aft end of the squealer tip cavity 62 (i.e., the approximate position in the squealer tip cavity 62 where the trailing edge trench 72 originates) and the depth at the aft end of the trailing edge trench 72 may be between approximately 60% and 0% of the depth of the aft end of the squealer tip cavity 62. More preferably, the depth at the forward end of the trailing edge trench 72 may be between approximately 100% and 75% of the depth of the aft end of the squealer tip cavity 62 (i.e., the approximate position in the squealer tip cavity 62 where the trailing edge trench 72 originates) and the depth at the aft end of the trailing edge trench 72 may be between approximately 50% and 10% of the depth of the aft end of the squealer tip cavity 62.

In some embodiments, the trailing edge trench 72 may have a substantially constant width as it extends from the squealer tip cavity 62 to the trailing edge 34. Note that as used herein, the width of the trench 72 is meant to comprise the distance across the trench 72 at its mouth. In preferred embodiments, the width of the squealer tip cavity 62 generally may be between 95% and 40% of the width of the aft end of the squealer tip cavity 62 (i.e., the approximate position in the squealer tip cavity 62 where the trailing edge trench 72 originates). More preferably, the width of the squealer tip cavity 62 may be between 80% and 50% of the width of the aft end of the squealer tip cavity 62.

In other preferred embodiments, the width of the trailing edge trench 72 may gradually decrease as the trench 72 extends from the aft end of the squealer tip cavity 62 toward the trailing edge 34 of the airfoil. In such cases, the width of the trench 72 generally narrows in proportion to the narrowing shape of the aft end of the blade tip 38. The width of trench 72, in such embodiments, generally may be between approximately 30%-80% of the width of the blade tip 38 through aft end of the airfoil. More preferably, the width of trench may be between approximately 40%-70% of the width of the blade tip 38 through aft end of the airfoil.

Note that the transition between the squealer tip cavity 62 and the trailing edge trench 72 may be made in several different ways. For example, the transition between the squealer tip cavity 62 and the narrower width of the squealer tip cavity 62 may be "stepped" in nature (i.e., a sharp corner) or have a blended edge (i.e., a smooth or rounded corner). As one of ordinary skill in the art will appreciate, in some applications, the blended edge may promote smoother flow into the trailing edge trench 72, which, generally, may allow more of the cooling air to remain in the trailing edge trench 72 as it moves toward the trailing edge 34 of the blade tip 38, which may enhance the cooling effects of the air.

The trailing edge trench 72 may have one or more trench cooling apertures 74, which similar to the previously discussed cooling apertures. The trench cooling apertures 74 are openings within the trench 72 that connect to cooling cavities within the airfoil. Per conventional means, a coolant may be directed through the trench cooling apertures 74 and, along with the flow of coolant from the squealer tip cavity 62, keep the surrounding surface area of the blade tip 38 cool by convecting away heat and insulating the part from the extreme temperatures of the working fluid. More particularly, the coolant may better cool the trailing edge portion of the blade tip 38. As shown, the trench cooling apertures may be regularly spaced through the trailing edge trench 72 and positioned on the floor of the trench 72, i.e., near the deepest portion of the trench 74.

Figure 5:
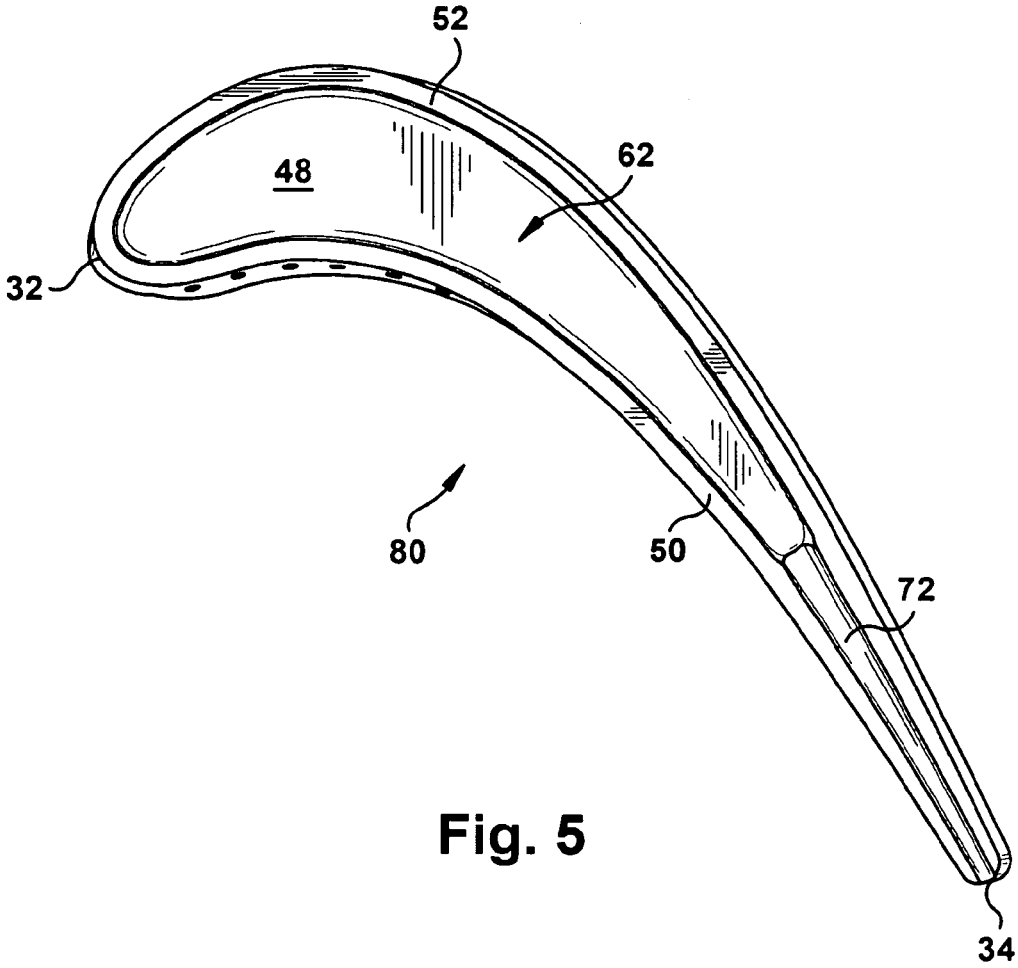
FIG. 5 is a top view of a turbine rotor blade have a tip pursuant to an alternative embodiment of the present invention.

FIG. 5 illustrates an alternative embodiment of the present invention, a rotor blade 80. The blade 80 is similar to the blade 70, but lacks the trench cooling apertures 74 that are described above. As discussed in more detail below, in such instances, coolant from the squealer tip cavity 62 may flow into the trailing edge trench 72 during operation and be directed toward the trailing edge 34 of the blade tip 38, thereby cooling it.

Figure 6:
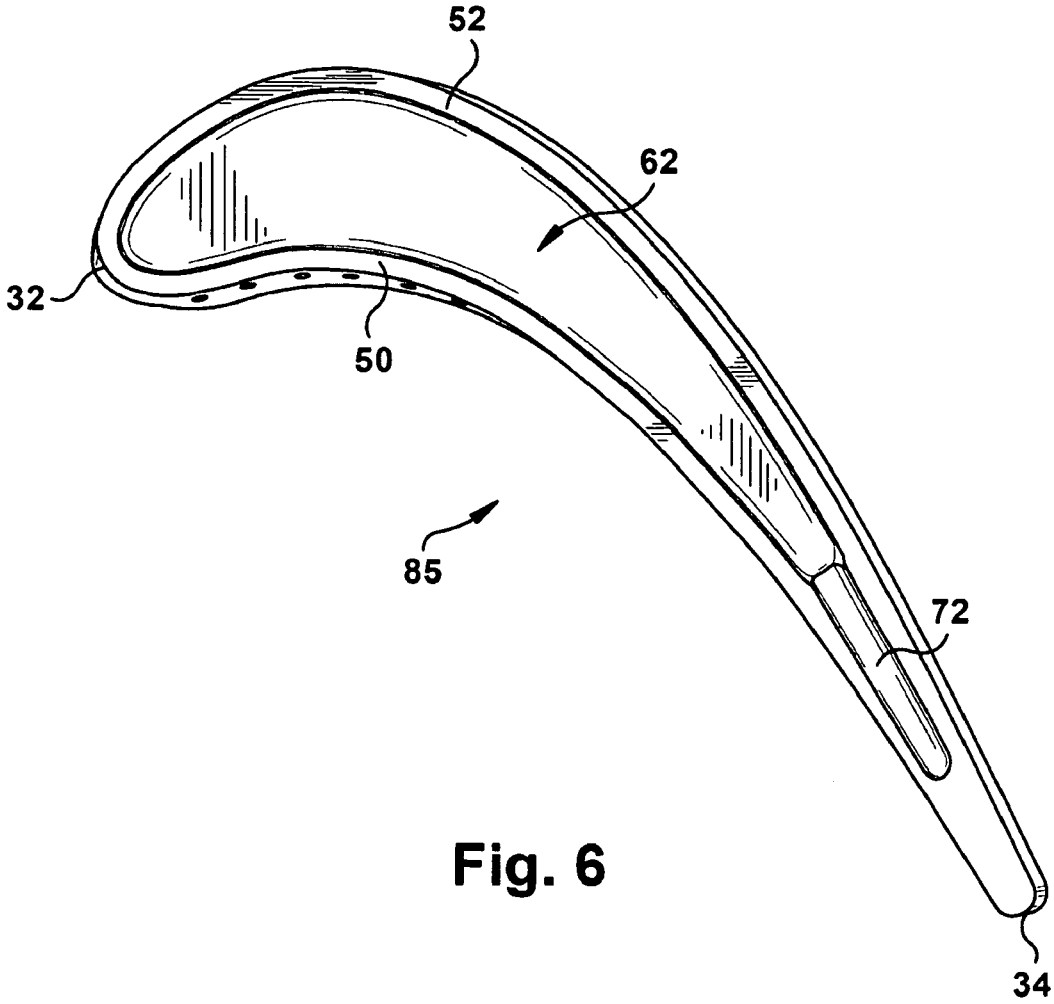
FIG. 6 is a top view of a turbine rotor blade have a tip pursuant to an alternative embodiment of the present invention.
Figure 7:
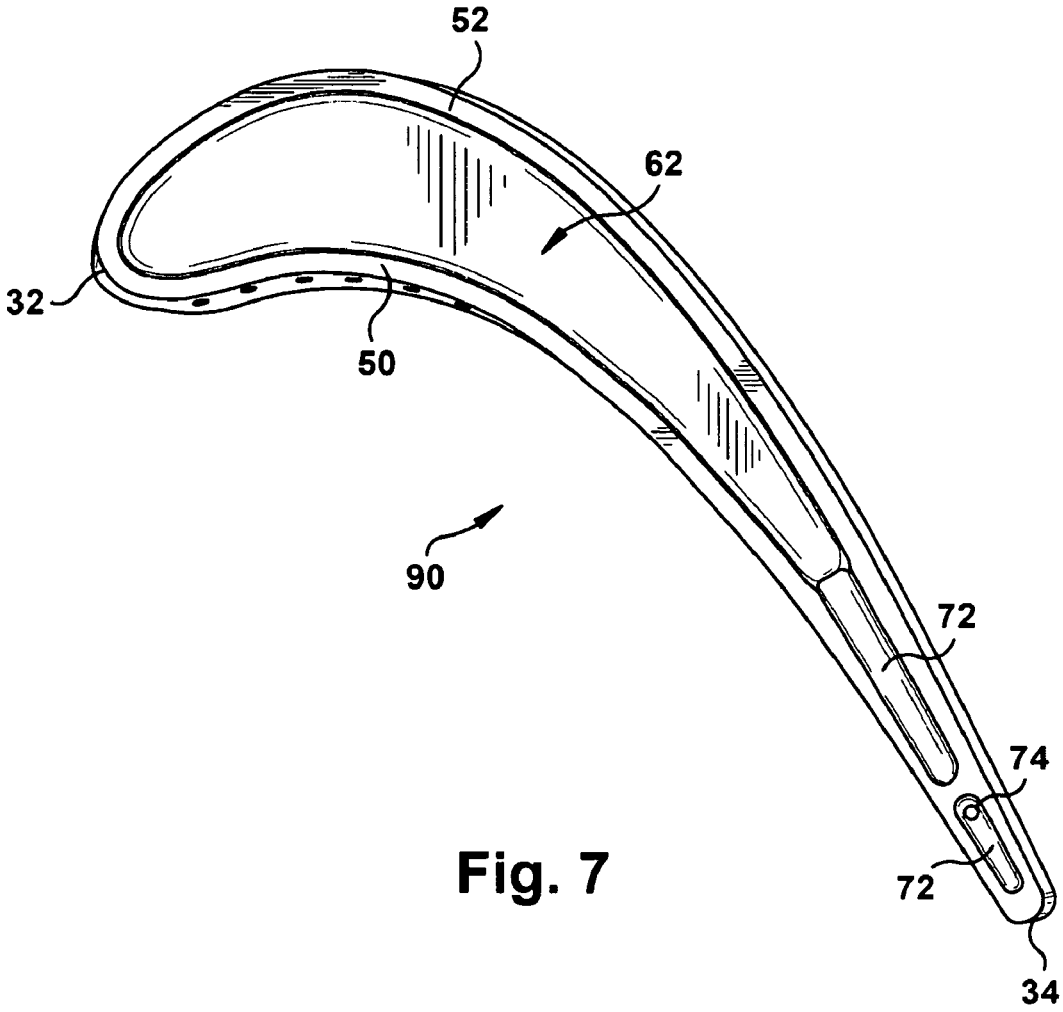
FIG. 7 is a top view of a turbine rotor blade have a tip pursuant to an alternative embodiment of the present invention.

FIGS. 6 and 7 show two other exemplary embodiments of the present application, a blade 85 and a blade 90, respectively. As shown in FIG. 6, in certain embodiments, the trailing edge trench 72 may extend for only a portion of the distance between the squealer tip cavity 62 and the trailing edge 34 of the blade tip 38. In such embodiments, the trailing edge trench 72 generally originates in the squealer tip cavity 62, extends toward the trailing edge 34 of the blade tip 38, and terminates at a position short of the trailing edge 34. Generally, in such embodiments, the trench 72 will extend between approximately 40% and 90% of the distance between the aft end of the squealer tip cavity 62 and the trailing edge 34.

As shown in FIG. 7, in other embodiments, the trailing edge trench 72 may extend for only a portion of the distance between the squealer tip cavity 62 and the trailing edge 34 and a second trailing edge trench 72 may extend for another portion of the distance with the second trailing edge trench being in a position that is further aft than the trench 72 that connects to the squealer tip cavity 62. In such embodiments, for example, the trailing edge trench 72 generally originates in the squealer tip cavity 62, extends toward the trailing edge 34 of the blade tip 38, and terminates at a position short of the trailing edge 34. Then, the second trailing edge trench 72 begins at a position that is further aft that the termination point and extends toward the trailing edge 34 of the blade tip 38, and, as shown, terminates at a position short of the trailing edge 34. In other embodiments, not shown, the second trailing edge trench 72 may extend through the trailing edge 34 of the blade tip 38. As shown, one or more trench cooling apertures 74 may be positioned in the aft positioned trench 72. As one of ordinary skill in the art will appreciate, the features and variations discussed above in relation to the embodiment of FIGS. 3 and 4 may be applied to the alternative embodiments discussed herein.

In use, the trailing edge trench 72 generally improves the cooling of the trailing edge 34 of the blade tip 38 without an increase in the amount of coolant flow. The trench 72 generally takes coolant flow of the squealer tip cavity 62 that would otherwise be washed over the suction tip wall 52 and directs it toward the trailing edge 34 of the blade tip 38. Particularly, the trailing edge trench 72 generally provides a downstream oriented path that allows the coolant within the squealer tip cavity 62 to more effectively reach the lower pressure gradients that generally exist during operation at the trailing edge 34 of the blade tip 38. The coolant thereby reaches the trailing edge region without: 1) being washed away by the pressure side hot gases; or 2) without creating disturbances on the suction side flow. Further, as one of ordinary skill in the art will appreciate, the resulting decrease in trailing edge temperatures generally reduces the amount of oxidation that occurs during operation along the trailing edge 34 of the blade tip 38. The reduction of oxidation improves the aerodynamic performance of the airfoil and, ultimately, reduces repair costs. In addition, the flow patterns that results from the geometry of the trailing edge trench 72 act as a seal across that portion of the blade tip 38 as they prevent flow from slipping over the blade tip 38 from the pressure side to the suction side, which, as one of ordinary skill in the art will appreciate, improves engine performance. As such, in sum, the trailing edge trench of the present application generally decreases the metal temperatures at the trailing edge of the blade tip, thereby increasing the part life, improving the performance of the engine by preventing oxidation, and reducing the costs of maintenance, while also improving engine efficiency with its better sealing characteristics.

From the above description of preferred embodiments of the invention, those skilled in the art will perceive improvements, changes and modifications. Such improvements, changes and modifications within the skill of the art are intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

We claim:

1. A blade tip of a turbine rotor blade for a gas turbine engine, the turbine rotor blade including an airfoil and a root portion for mounting the airfoil along a radial axis to a rotor disk inboard of a turbine shroud, a pressure sidewall and a suction sidewall that join together at a leading edge and a trailing edge, the pressure sidewall and suction sidewall extending from the root portion to the blade tip, and a squealer tip cavity formed at the blade tip, the blade tip comprising:

a trailing edge trench originating at the squealer tip cavity, wherein the trailing edge trench generally extends toward the trailing edge of the blade tip.

2. The turbine blade according to claim 1, wherein:

the blade tip comprises a tip plate that extends between the outer radial edge of the pressure sidewall to the outer radial edge of the suction sidewall;

the squealer tip cavity is formed on a first side by a pressure tip wall that extends radially outwardly from the tip plate, traversing from the leading edge to the trailing edge such that the pressure tip wall resides approximately adjacent to the termination of the pressure sidewall; and the squealer tip cavity is formed on a second side by a suction tip wall that extends radially outwardly from the tip plate, traversing from the leading edge to the trailing edge such that the suction tip wall resides approximately adjacent to the termination of the suction sidewall.

3. The turbine blade according to claim 2, wherein the trailing edge trench comprises one of a depression and a groove that originates at the aft end of the squealer tip cavity and extends toward the trailing edge of the blade tip.

4. The turbine blade according to claim 2, wherein:

a tip mid-chord line comprises a reference line extending from the leading edge to the trailing edge that connects the approximate midpoints between the pressure tip wall and the suction tip wall; and the trailing edge trench is approximately aligned with the tip mid-chord line.

5. The turbine blade according to claim 2, wherein the trailing edge trench is positioned such that it is closer to the pressure sidewall than the suction sidewall.

6. The turbine blade according to claim 2, wherein:

the path of the trailing edge trench is one of linear, arcuate, serpentine and zig-zag in shape; and the profile of the trailing edge trench is one of semi-elliptical, rectangular, semi-circular, triangular, trapezoidal, "V" shaped, and "U" shaped.

7. The turbine blade according to claim 2, wherein:

the depth of the trailing edge trench is substantially constant as it extends from the squealer tip cavity toward the trailing edge of the blade tip; and the depth of the trailing edge trench comprises a depth that is between approximately 110% and 40% of the depth of the aft end of the squealer tip cavity.

8. The turbine blade according to claim 7, wherein the depth of the trailing edge trench comprises a depth that is between approximately 100% and 75% of the depth of the aft end of the squealer tip cavity.

9. The turbine blade according to claim 2, wherein:

the depth of the trailing edge trench varies as it extends toward the trailing edge of the blade tip;

the depth of the trailing edge trench gradually become shallower as the trench extends toward the trailing edge of the blade tip; and the depth at the forward end of the trailing edge trench comprises a depth of between approximately 110% and 40% of the depth of the aft end of the squealer tip cavity and the depth at the aft end of the trailing edge trench comprises a depth of between 60% and 0% of the depth of the aft end of the squealer tip cavity.

10. The turbine blade according to claim 9, wherein the depth at the forward end of the trailing edge trench comprises a depth of between approximately 100% and 75% of the depth of the aft end of the squealer tip cavity and the depth at the aft end of the trailing edge trench comprises a depth of between 50% and 10% of the depth of the aft end of the squealer tip cavity.

11. The turbine blade according to claim 2, wherein:

the trailing edge trench comprises a substantially constant width as it extends from the squealer tip cavity to the trailing edge of the tip blade; and the width of the trailing edge trench comprises a width that is between approximately 95% and 20% of the width of the aft end of the squealer tip cavity.

12. The turbine blade according to claim 11, wherein the width of the squealer tip cavity comprises a width that is between approximately 80% and 40% of the width of the aft end of the squealer tip cavity.

13. The turbine blade according to claim 2, wherein the width of the trailing edge trench gradually decreases as the trench extends from the aft end of the squealer tip cavity toward the trailing edge of the blade tip.

14. The turbine blade according to claim 2, wherein:

the width of the trailing edge trench narrows in proportion to the narrowing shape of the aft end of the blade tip; and the width of trailing edge trench comprises a width that is between approximately 20% and 80% of the width of the blade tip.

15. The turbine blade according to claim 14, wherein the width of trailing edge trench comprises a width that is between approximately 30% and 70% of the width of the blade tip.

16. The turbine blade according to claim 2, wherein the trailing edge trench comprises at least one trench cooling apertures, the trench cooling apertures comprising openings within the trailing edge trench that connect to one or more cooling cavities within the airfoil.

17. The turbine blade according to claim 2, wherein the trailing edge trench extends from the squealer trench cavity to the trailing edge of the blade tip.

18. The turbine blade according to claim 2, wherein the trailing edge trench extends from the squealer trench cavity to a position that is forward of the trailing edge of the blade tip.

19. The turbine blade according to claim 18, wherein the distance that the trailing edge trench extends from the squealer tip cavity is between approximately 40% and 90% of the distance between the squealer tip cavity and the trailing edge of the blade tip.

20. The turbine blade according to claim 18, wherein:

the trailing edge trench that extends from the squealer trench cavity to a position that is forward of the trailing edge of the blade tip comprises a first trailing edge trench; and a second trailing edge trench is formed downstream of the downstream termination point of the first trailing edge trench.

21. The turbine blade according to claim 20, wherein the second trailing edge trench extends downstream to one of: i) a position that is forward of the trailing edge of the blade tip; and ii) the trailing edge of the blade tip.

22. The turbine blade according to claim 20, wherein the second trailing edge trench comprises at least one trench cooling apertures.

23. The turbine blade according to claim 2, wherein a transition between the squealer tip cavity and the trailing edge trench comprises one of a step and a blended edge.

24. The turbine blade according to claim 2, wherein the trailing edge trench further comprises a corrosion inhibitor coating with a high aluminum content.

* * * * *